US006439820B1

(12) United States Patent
Lehner et al.

(10) Patent No.: US 6,439,820 B1
(45) Date of Patent: Aug. 27, 2002

(54) METHOD OF BINDING A PROTECTIVE COVER TO MAGAZINES

(76) Inventors: Daniel A. Lehner, *deceased*, late of Valley Stream, NY (US); by Remy D. Lehner, executrix, 125 S. Cottage St., Valley Stream, NY (US) 11580

( * ) Notice: Subject to any disclaimer, the term of this patent is extended or adjusted under 35 U.S.C. 154(b) by 29 days.

(21) Appl. No.: 09/610,141

(22) Filed: Jul. 5, 2000

(51) Int. Cl.[7] ..... B42C 11/00

(52) U.S. Cl. ..... 412/4; 412/1; 412/8; 412/900; 412/37

(58) Field of Search ..... 412/1, 2, 3, 4, 412/5, 8, 17, 900, 901, 902

(56) References Cited

U.S. PATENT DOCUMENTS 5,295,775 A * 3/1994 Andjelic et al. ..... 412/8 X
5,647,715 A * 7/1997 Stolz ..... 412/4 X
5,868,539 A * 2/1999 Rathert ..... 412/4 X
6,199,851 B1 * 3/2001 Latvakangas et al. ..... 412/8 X

* cited by examiner

*Primary Examiner*—Willmon Fridie, Jr.
(74) *Attorney, Agent, or Firm*—Collen IP; Robert M. McDermott

(57) ABSTRACT

A process for producing protective covers for magazines is optimized for low cost and fast turnaround. A variety of techniques are employed within this process, each of which provides a cost or time advantage compared to conventional fabrication techniques. To optimize turnaround time, the glue that is used to adhere the protective cover to the magazine is formulated to be extremely aggressive and extremely fast drying. To assure consistent aggression and drying, the gluing process is regulated by the source of glue, based on the availability of glue at the appropriate application temperature. To further assure consistent aggression, particularly with high-gloss or relatively thin magazines, the gluing process includes an optional brushing of the exterior spine of the magazine to provide a suitable surface area to which the glue adheres. To minimize production cost and time, the gluing process includes a printing of magazine title on the exterior spine of the cover simultaneously with the application of glue to the exterior spine of the magazine, thereby eliminating the need to preprint and presort covers for each magazine title.

18 Claims, 2 Drawing Sheets

METHOD OF BINDING A PROTECTIVE COVER TO MAGAZINES

BACKGROUND OF THE INVENTION

1. Field of the Invention

This invention relates to the field of publication, and in particular to the binding of a protective cover to magazines, for use on airplanes, trains, buses, and so on.

2. Description of Related Art

Protective covers are commonly used to protect printed material from the normal wear and tear caused by repeated handling of the printed material. Airlines and other public carriers often offer their customers reading material for their enjoyment during the flight. This provided material includes 'repeated use' material, such as a magazine, that is intended to be read by a passenger, then returned for reading by other passengers. Each magazine thus provided is intended to last for a month or more, and will typically be handled by dozens, or tens of dozens of passengers.

A number of techniques have been used to provide a suitable protective cover to magazines for use on an airline. Originally, reusable vinyl binders were used that contained a rod, beneath which the spine of the magazine was placed. These binders, however, required the manual replacement of each magazine when the next issue of the magazine was published, typically monthly. If the binders contained an identification of the magazine, this process could be very time consuming, because each new magazine would need to be collated with the corresponding binder. If the binders did not contain an identification of the magazine, boarding delays were incurred as passengers spent time at the entry way hunting for their favorite reading material.

Another problem with these binders was the weight of the binders. Generally, a metal frame was required to hold the rod that affixed the magazine within the folder. Depending upon the desired robustness of the binder, the desired ease of replacing the magazine each month, and other factors, the frame could be quite substantial. The combined weight of the vinyl protective cover and metal attachment device could be significant. The airline industry is extremely weight conscious, and a less weighty solution is preferred.

The replacement of the magazines in the binders with each new issue also introduced the potential for a dishonest use of the removed magazine. If the magazine did not show evidence of use, one could attempt to sell the magazine as new, or, in conjunction with a magazine retailer, could return the magazine as an unsold prior issue. Magazine publishers routinely credit retailers for unsold copies of their magazine, in order to encourage retailers to keep their shelves stocked with the magazine, without a risk of loss to the retailer because of an overstock.

Disposable protective covers alleviated some of the manual labor burden, and reduced the weight of the covers by simplifying the means used to affix the magazine to the cover. Because the protective cover only had to last a month or so, the affixing rod could be replaced by an elastic cord attached to the cover at top and bottom that ran the length of the magazine's spine, thereby reducing the cost and weight of the cover. By the end of the month or so, however, these elastic cords were likely to fail, particularly in the covers used to contain popular and/or heavy magazines. It was not unusual to find numerous magazines separated from their covers at the end of each flight. U.S. Pat. No. 4,128,262, "Magazine Cover", issued Dec. 5, 1978 to Du Corday, presents a plastic cover with a slot formed in a reinforced spine, with pockets for inserting the magazine cover sheet, and is incorporated by reference herein. Presumably, this cover was inexpensive enough to be disposable if required, but durable enough to be reused.

Another type of disposable protective covers includes a plastic and paper stock cover that is affixed to the magazine by an adhesive spine. Being of plastic and paper stock material, the thickness, and therefore the weight, of the cover can be optimized to provide an appropriate level of durability. A clear or semi-clear plastic sheet is used as a front cover, to allow the front cover of the magazine to be seen, and a heavy stock paper sheet is used as a rear cover. The use of a paper sheet allows advertisements to be included on the cover, thereby providing revenue to offset the cost of providing the cover. An adhesive strip runs the length of the spine, and serves to adhere the front and back covers to the magazine in the vicinity of the spine. U.S. Pat. No. 5,178,414, "Protective Magazine Cover" issued Jan. 12, 1993 to Small et al discloses such a technique, and is incorporated by reference herein. Other techniques have also been disclosed, including DE 4416668, issued Nov. 17, 1994 to Elissen et al, wherein the front and rear covers are designed to overlay, and each wrap around the spine.

The latest generation of disposable, permanently affixed, protective covers include a paper and plastic cover that is glued directly to the spine of the magazine. Being glued to the magazine, the likelihood of the cover being separated from the magazine is minimal. The plastic portion of the cover substantially forms the front of the cover, and is clear to provide an easy identification of the included magazine. The paper stock portion of the cover, which extends across the spine and forms the back cover, includes advertising on the rear cover, and is also configured to facilitate subsequent printing, so that an identification of the included magazine can be printed on the spine, to ease the task of finding a preferred magazine among a variety of magazines.

At least a million magazines are provided to the various airlines each month, and therefore a reduction in the cost of providing protective covers for these magazines has the potential of generating significant additional profits, or the potential of generating a significantly greater market share to a vendor who can provide the product at a lower price.

BRIEF SUMMARY OF THE INVENTION

It is an object of this invention to provide a cost effective process for producing protective covers for magazines. It is a further object of this invention to provide a fast-turnaround process for producing protective covers for magazines. It is a further object of this invention to provide an efficient and cost effective process for producing robust protective covers for magazines.

These objects and others are achieved by providing a process for producing protective covers that is optimized for low cost and fast turnaround. A variety of techniques are employed within this process, each of which provides a cost or time advantage compared to conventional fabrication techniques. To optimize turnaround time, the glue that is used to adhere the protective cover to the magazine is formulated to be extremely aggressive and extremely fast drying. To assure consistent aggression and drying, the gluing process is regulated by the source of glue, based on the availability of glue at the appropriate application temperature. To further assure consistent aggression, particularly with high-gloss or relatively thin magazines, the gluing process includes an optional brushing of the exterior spine of the magazine to provide a suitable surface area for the glue to adhere. To minimize production cost and time, the gluing process includes printing of the magazine title on the exterior spine of the cover simultaneously with the application of glue to the exterior spine of the magazine, thereby eliminating the need to preprint and presort covers for each magazine title.

BRIEF DESCRIPTION OF THE DRAWINGS

The invention is explained in further detail, and by way of example, with reference to the accompanying drawings wherein.

Throughout the drawings, the same reference numerals indicate similar or corresponding features or functions.

DETAILED DESCRIPTION OF THE INVENTION

Figure 1:
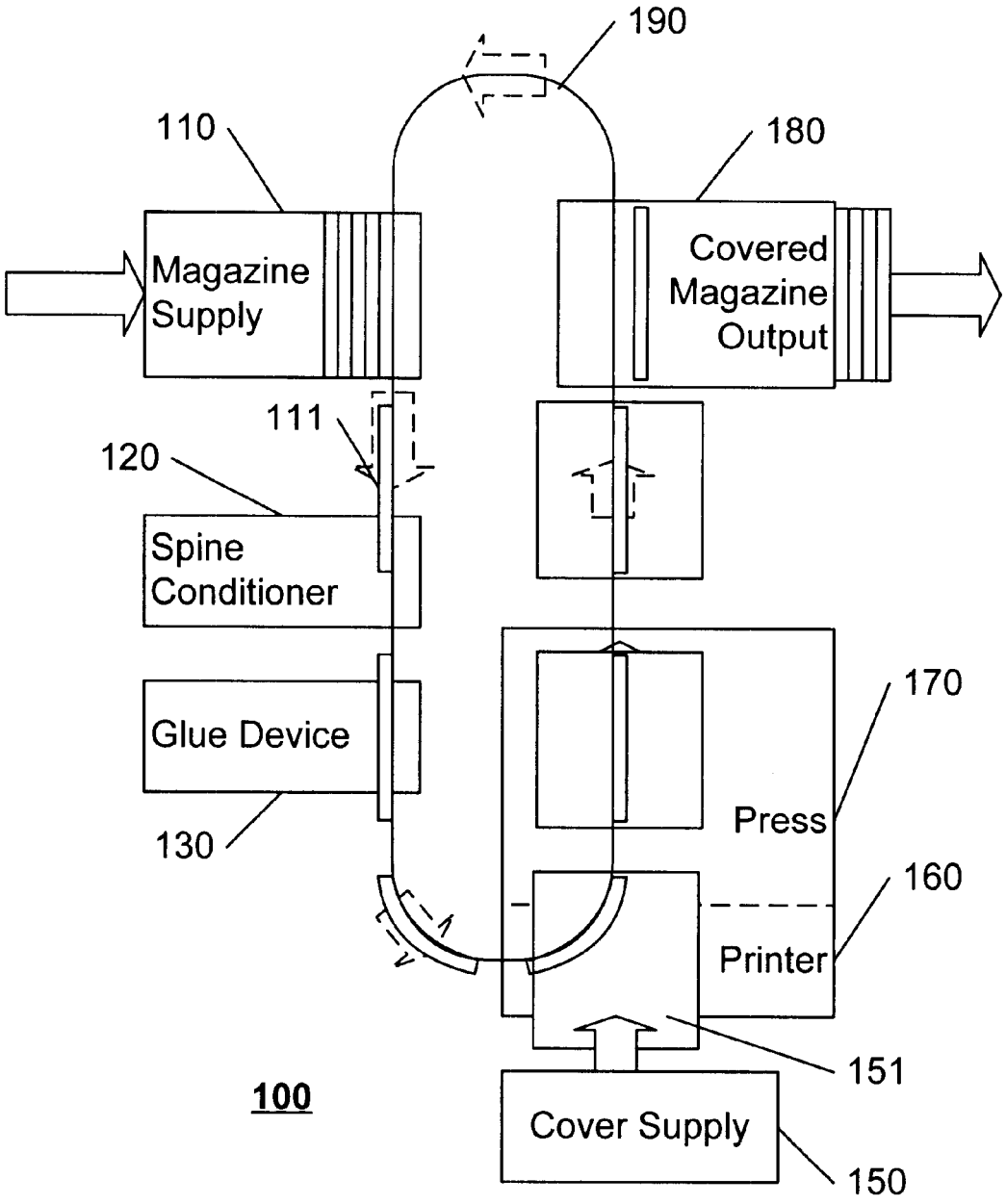
FIG. 1 illustrates an example process for binding a protective cover to a magazine while simultaneously printing an identification of the magazine on the spine of the protective cover in accordance with this invention.
Figure 2A:
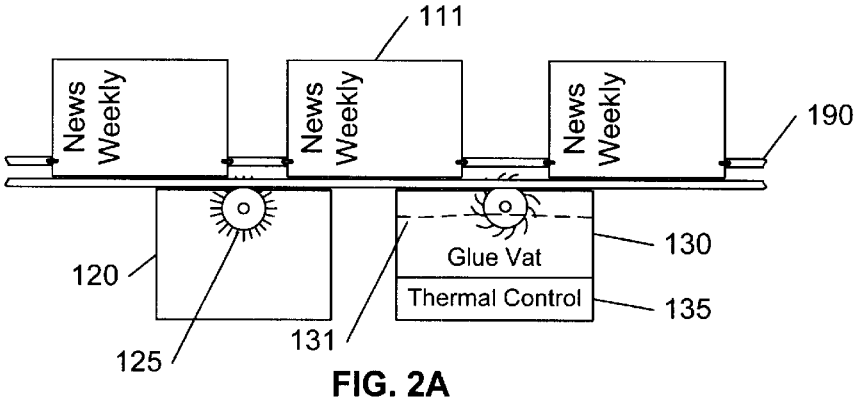
FIGS. 2A and 2B illustrate an alternative view of the example process for binding a protective cover to a magazine while simultaneously printing an identification of the magazine on the spine of the protective cover in accordance with this invention.
Figure 2B:
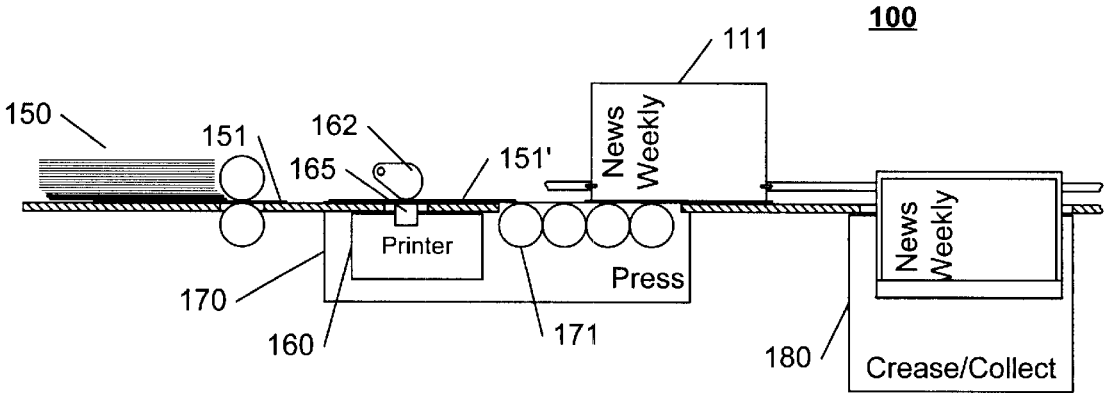

FIG. 1 illustrates an example process 100 for binding a protective cover 151 to a magazine 111 while simultaneously printing an identification of the magazine 111 on the spine of the protective cover 151 in accordance with this invention. FIGS. 2A and 2B illustrate an alternative view of the example process 100.

A supply device 110 provides individual copies of the magazine 111 to a conveyance system 190. The conveyance system 190 transports the magazine 111 to a spine conditioner 120, which optionally conditions the spine of the magazine 111 to enhance the adhesion of subsequently applied glue.

The conventional technique for enhancing the adhesion characteristics of a spine of a book is to transversely score the spine of the book by passing the spine of the book over a plurality of blades that cut slots substantially perpendicular to the length of the spine. This conventional technique, however, cannot be used with magazines that contain staples on the spine, because the blades that are used to score the spine will tend to rip the staples out, causing damage to the magazine and/or damage to the conditioning device. The conventional scoring is also somewhat ineffective on magazines having a very glossy surface, because the enhanced adhesion only occurs within the narrow score lines.

In accordance with a first aspect of this invention, the spine conditioner 120 includes a wire brush 125 (FIG. 2A) that is configured to brush the surface of the spine of the magazine 111 longitudinally. By brushing the spine longitudinally, there are no cross-spine forces applied that would have a tendency to tear out the staples, which are also arranged longitudinally. By using a wire brush, the adhesion qualities of high-gloss magazines can also be enhanced, by substantially removing the gloss from the spine of the magazine. Magazines that are not glossy and which do not include staples can be scored using the conventional techniques, if required, or left unaltered. Some magazines have spines that have sufficient adhesion qualities such that the conditioning process 120 need not be applied.

After the optional spine conditioner 120, the conveyance system 190 transports the magazine 111 to the glue device 130. In accordance with another aspect of this invention, a hot glue is used to adhere the protective cover 151 to the spine of the magazine 111. The preferred process is optimized to provide a reliable adhesion while also providing an high throughput rate. As noted above, a highly aggressive adhesion is desired, such that a subsequent removal of the cover 151 from the magazine 111 will substantially damage the magazine 111. This damage is desired in order to prevent a return of the magazine 111 to the publisher for credit as an "unused" magazine. By assuring the prevention of fraudulent returns, the publisher is likely to offer copies of the magazine at a lesser price than conventionally distributed copies, which often include an assumed loss factor that is based on a expected rate of return.

To achieve the desired adhesion and drying characteristics, the process 100 in accordance with this invention is regulated by the availability of glue at a specified temperature that assures these adhesion and drying characteristics. The glue device 130 includes a thermal control device 135 that regulates the heating of the glue in the glue device 130. In accordance with this aspect of the invention, the entire process 100 is halted if the glue in the device 130 falls below a certain minimum level, or is not within the specified temperature range.

In a preferred embodiment, Hot Melt Adhesive HL 3204, from H.B. Fuller Company, 3530 North Lexington Avenue, St. Paul, Minn. 55126, has been found to provide the appropriate adhesion and drying characteristics. If applied within a temperature range of 430+/−40 degrees Farenheit, the glue will remain aggressive for approximately 2 to 3 seconds, and will be dry to the touch within 3 to 4 seconds of first being applied, in a typical factory environment of approximately 65–75 degrees Farenheit, at less than 80% humidity. By controlling the temperature of the glue to be within these specified limits, a throughput rate of approximately 2500 magazines per hour can be achieved.

The conveyance device 190 transports the magazine 111 to a press 170, whereat it is pressed by rollers 171 upon the protective cover 151, thereby allowing the glue that was applied to the spine of the magazine 111 to secure the cover 151 to the magazine 111. The conveying device 190 continues to transport the magazine 111 to an output device 180 that creases the cover 151 about the magazine 111, preferably using pre-scored fold-lines on the cover 151 in the spine region. In a preferred embodiment, the output device 180 is placed along the path of the conveyance device 190 such that the output device 180 is a specified time-distance from the glue device 130 when the conveyance device 190 is operated at its specified speed, the time-distance being dependent upon the drying time of the glue when the glue is applied at its specified application temperature. In the example embodiment using the HL 3205 glue, the output device 180 is placed approximately 3 seconds up the line from the glue device 130, thereby allowing the magazine 111 with adhered protective cover 151 to be bundled with other magazines 111 with covers 151, without a risk of the bundled magazines and covers adhering to each other. In accordance with this invention, this risk is avoided by assuring that the glue is applied within its specified temperature range.

As noted above, the ease of locating a desired magazine by a potential reader is substantially improved via an identification of the magazine 111 on the spine of the protective cover 151. This is particularly important in an airplane environment, wherein there is insufficient wall surface area available for displaying the front covers of each magazine, and wherein an iterative selection-rejection process interrupts a continuous flow of passengers into a plane during the boarding process. Although the covers 151 could be pre-printed with each of the different magazine titles, such an approach requires maintaining an inventory of each set of labeled covers, and requires the reloading of the cover supply device 150 with the appropriately labeled cover with each change of magazines 111 that is being bound.

In accordance with another aspect of this invention, the protective cover 151 is printed simultaneously with the binding process, thereby eliminating the need to stock differently pre-printed covers, and thereby eliminating the associated coordination of activities required to support the stocking and providing of corresponding pre-printed covers for each magazine. A printer 160 is integral to the process 100, and includes a print head 165 that prints an identification of the magazine on a region of the cover corresponding to the external surface of the spine of the cover 151 when the cover 151 is adhered to the spine of the magazine 111. As illustrated in FIG. 2B, a weight 162 may be applied to the cover 151 as it traverses the region of the print head 165, to assure proper printing.

Figure 3A:
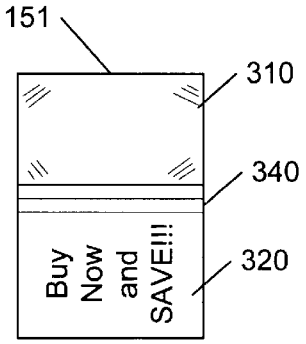
FIGS. 3A and 3B illustrate an example cover with a spine that is printed with an identification of a magazine in accordance with this invention.
Figure 3B:
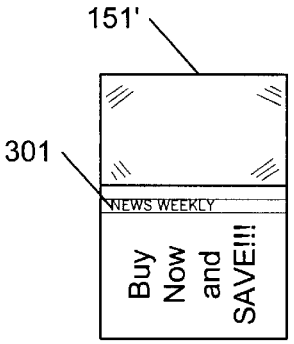

FIGS. 3A and 3B illustrate an example cover 151 with a spine region 340 that is printed with an identification of the magazine 111 to which it is to be adhered. FIG. 3A illustrates the cover 151 before, and FIG. 3B illustrates the cover 151' after, the printing of the identification 301 of the magazine. As noted above, the cover 151 preferably contains a clear plastic portion 310 that forms a substantial majority of the front cover area, and a paper stock portion 320 that allows for a pre-printed advertisement. In a preferred embodiment, the plastic portion is a polyester film material, 4 mils thick, and the portion 320 is 12 gauge paper stock. The stock portion 320 is preferably scored at the spine region 340 to facilitate a folding of the cover 151 about the magazine 111 after the magazine is adhered to the cover 151 at a surface on the reverse side of the the spine region 340 of FIG. 3A. Not illustrated, the stock material 320 extends over the plastic material 310, and is adhered to the plastic material 310 via a conventional cold-glue process, such as used for attaching plastic "windows" in boxes used for retail sales. Although the attachment of the plastic 310 to the paper 320 could be integral to the gluing process, the operational gains are expected to be minimal, and in a preferred embodiment, the bonding of the paper stock 320 and clear cover 310 is effected via an independent cold-glue process.

The foregoing merely illustrates the principles of the invention. It will thus be appreciated that those skilled in the art will be able to devise various arrangements which, although not explicitly described or shown herein, embody the principles of the invention and are thus within the spirit and scope of the following claims.

I claim:

1. A method of adhering a protective cover to a magazine, comprising:

applying a hot glue to an exterior spine of the magazine at a first time, bringing the exterior spine of the magazine in contact with an interior spine of the protective cover at a second time after the first time, to produce a protected magazine, and discharging the protected magazine at a third time after the second time, wherein a minimum time interval between the third time and the first time is required to assure adhesion of the protective cover to the magazine, and is determined by a temperature of the hot glue, and the method further includes regulating the temperature of the hot glue to provide a preferred temperature at which the minimum time interval can be achieved, and controlling the application of the hot glue, and thereby other elements of this method, in dependence upon an availability of the hot glue at the preferred temperature.

2. A method of adhering a protective cover to a magazine, comprising:

applying a hot glue to an exterior spine of the magazine at a first time, bringing the exterior spine of the magazine in contact with an interior spine of the protective cover at a second time after the first time, to provide a protected magazine, and discharging the protected magazine at a third time after the second time, wherein a minimum time interval between the third time and the first time is required to assure adhesion of the protective cover to the magazine, and is determined by a temperature of the hot glue, and the method further includes regulating the temperature of the hot glue to provide a preferred temperature at which the minimum time interval can be achieved, controlling the application of the hot glue, and thereby other elements of this method, in dependence upon an availability of the hot glue at the preferred temperature, and enhancing an adhesion quality of the exterior spine of the magazine immediately before applying the hot glue, by at least one of:

scoring the exterior spine of the magazine, and brushing the exterior spine of the magazine.

3. The method of claim 2, further including:

printing an identifier of the magazine on an exterior spine of the protective cover between the first time and the second time.

4. The method of claim 2, further including:

printing an identifier of the magazine on an exterior spine of the protective cover between the first time and the second time.

5. The method of claim 2, wherein the protective cover includes a paper stock material that forms a back of the protective cover, the spine of the protective cover, and at least a portion of a front of the protective cover, and a substantially transparent film that forms a remaining portion of the front of the protective cover, and the method also includes adhering the transparent film to the paper stock.

6. The method of claim 1, wherein the hot glue is formulated such that a removal of the protective cover from the magazine after the third time causes noticeable damage to the magazine.

7. The method of claim 1, wherein the hot glue comprises Hot Melt Adhesive HL 3204 of H.B. Fuller Company, the second time is within three seconds of the first time, and the third time is within four seconds of the first time.

8. A method of adhering a protective cover to a magazine, comprising:

brushing the exterior spine of the magazine longitudinally, applying a hot glue to an exterior spine of the magazine at a first time, bringing the exterior spine of the magazine in contact with an interior spine of the protective cover at a second time after the first time, to produce a protected magazine, and discharging the protected magazine at a third time after the second time.

9. A method of adhering a protective cover to a magazine, comprising:

brushing an exterior spine of the magazine longitudinally, applying a hot glue to the exterior spine of the magazine at a first time, bringing the exterior spine of the magazine in contact with an interior spine of the protective cover at a second time after the first time, to produce a protected magazine, discharging the protected magazine at a third time after the second time, and printing an identifier of the magazine on an exterior spine of the protective cover substantially coincident in time with applying the hot glue.

10. The method of claim 9, wherein the protective cover includes a paper stock material that forms a back of the protective cover, the spine of the protective cover, and at least a portion of a front of the protective cover, and a substantially transparent film that forms a remaining portion of the front of the protective cover, and the method also includes adhering the transparent film to the paper stock.

11. The method of claim 8, wherein the hot glue is formulated such that a removal of the protective cover from the magazine after the third time causes noticeable damage to the magazine.

12. A method of adhering a protective cover to a magazine, comprising:

applying a hot glue to an exterior spine of the magazine at a first time, printing an identifier of the magazine on an exterior spine of the protective cover substantially coincident in time with applying the hot glue.

bringing the exterior spine of the magazine in contact with an interior spine of the protective cover at a second time after the first time, to produce a protected magazine, and discharging the protected magazine at a third time after the second time.

13. The method of claim 12, further including:

enhancing an adhesion quality of the exterior spine of the magazine immediately before applying the hot glue, by at least one of:

scoring the exterior spine of the magazine, and brushing the exterior spine of the magazine.

14. The method of claim 12, wherein the protective cover includes a paper stock material that forms a back of the protective cover, the spine of the protective cover, and at least a portion of a front of the protective cover, and a substantially transparent film that forms a remaining portion of the front of the protective cover, and the method also includes adhering the transparent film to the paper stock.

15. The method of claim 12, wherein the hot glue is formulated such that a removal of the protective cover from the magazine after the third time causes noticeable damage to the magazine.

16. The method of claim 1, further including:

printing an identifier of the magazine on an exterior spine of the protective cover between the first time and the second time.

17. The method of claim 1, wherein the protective cover includes a paper stock material that forms a back of the protective cover, the spine of the protective cover, and at least a portion of a front of the protective cover, and a substantially transparent film that forms a remaining portion of the front of the protective cover, and the method also includes adhering the transparent film to the paper stock.

18. The method of claim 8, wherein the protective cover includes a paper stock material that forms a back of the protective cover, the spine of the protective cover, and at least a portion of a front of the protective cover, and a substantially transparent film that forms a remaining portion of the front of the protective cover, and the method also includes adhering the transparent film to the paper stock.

* * * * *